US006142607A

United States Patent [19]

Takata et al.

[11] Patent Number: 6,142,607

[45] Date of Patent: Nov. 7, 2000

[54] INK-JET RECORDING HEAD

[75] Inventors: Hisashi Takata, Takatsuki; Hideo Hotomi, Nishinomiya; Naoki Matsui; Shoichi Minato, both of Sakai; Keishi Sawada, Amagasaki, all of Japan

[73] Assignee: Minolta Co., Ltd., Osaka, Japan

[21] Appl. No.: 08/908,627

[22] Filed: Aug. 7, 1997

[30] Foreign Application Priority Data

| | | | |
|---|---|---|---|
| Aug. 7, 1996 | [JP] | Japan | 8-208575 |
| Aug. 23, 1996 | [JP] | Japan | 8-222182 |
| Sep. 24, 1996 | [JP] | Japan | 8-251482 |

[51] Int. Cl.[7] ..... B41J 2/14

[52] U.S. Cl. ..... 347/47

[58] Field of Search ..... 347/47, 45, 15, 347/20

[56] References Cited

U.S. PATENT DOCUMENTS

| | | | |
|---|---|---|---|
| 4,014,029 | 3/1977 | Lane et al. | 347/47 |
| 4,369,455 | 1/1983 | McConica et al. | 346/140 R |
| 4,454,519 | 6/1984 | Oosaka et al. | 347/45 |
| 4,503,444 | 3/1985 | Tacklind | 346/140 R |
| 4,587,534 | 5/1986 | Saito et al. | 347/47 |
| 4,707,705 | 11/1987 | Hara et al. | 347/45 |
| 5,208,605 | 5/1993 | Drake | 346/1.1 |
| 5,387,440 | 2/1995 | Takemoto et al. | 347/45 |
| 5,412,410 | 5/1995 | Rezanka | 347/15 |
| 5,467,115 | 11/1995 | Childers | 347/47 |

FOREIGN PATENT DOCUMENTS

| | | | |
|---|---|---|---|
| 0437062 | 7/1991 | European Pat. Off. . | |
| 59-87171 | 5/1984 | Japan . | |
| 59-190862 | 10/1984 | Japan | 347/47 |
| 60-139457 | 7/1985 | Japan . | |
| 2282992 | 4/1995 | United Kingdom . | |

*Primary Examiner*—John Barlow
*Assistant Examiner*—Charles W. Stewart, Jr.
*Attorney, Agent, or Firm*—Sidley & Austin

[57] ABSTRACT

An ink-jet recording head for use in an ink-jet printer comprises a plurality of head portions. Each of head portions includes an ink cavity for receiving an ink material, means for pressurizing the ink material in the ink cavity, and a nozzle through which the ink material is ejected. The nozzle has an individual cross section with respect to an axial direction thereof and the cross section of one head portion is different from that of another head portion.

10 Claims, 13 Drawing Sheets

INK-JET RECORDING HEAD

FIELD OF THE INVENTION

The invention relates to a Drop-On-Demand ink-jet recording head for use in an ink-jet printer, and particularly to an ink-jet recording head by which ink droplets are ejected through nozzles by pressurizing an ink material received in ink cavities in response to image signals and then deposited onto a recording medium such as paper to reproduce an image.

BACKGROUND OF THE INVENTION

There have been proposed so far a variety of Drop-On-Demand ink-jet recording heads. One known method for reproducing a continuous halftone image by use of the ink-jet recording head is to deposit large and small ink droplets onto a recording medium. For this purpose, large-diameter nozzles and small-diameter nozzles whose sizes are different from each other are provided for the head to achieve a gradation reproduction by suitably ejecting large and small ink droplets through the large-diameter and small-diameter nozzles, respectively, in response to image signals.

However, a wide range of gradation cannot be achieved simply by providing different diameters for respective nozzles, and a smooth halftone image like a photograph can not be reproduced.

Also, in order to form nozzles having different diameters in a head plate by laser beam machining, the diameter of the laser beam must be changed in accordance with the desired diameters. Instead, when forming the nozzles by drilling, various size of drills and corresponding tools must be prepared and further they must be exchanged depending upon the sizes of the desired diameters. Therefore, forming nozzles of different diameters has been a very complicated and inefficient approach.

SUMMARY OF THE INVENTION

Among the several objects and features of the present invention include the provision of an ink-jet recording head for use in an ink-jet printer capable of reproducing a smoother halftone image and reducing production cost.

An ink-jet recording head of the invention comprises a plurality of head portions. Each of the head portions includes an ink cavity for receiving an ink material, means for pressurizing the ink material in the ink cavity, and a nozzle through which the ink material is ejected. The nozzle has an individual cross section with respect to an axial direction thereof and the cross section of the nozzle of one head portion is different from the cross-section of the nozzle of the other head portion.

According to the ink-jet recording head of the present invention, due to the difference of the cross section of the nozzles in each of the head sections, a fluid resistance in each nozzle is different depending upon the head portions which thereby results in a difference of pressure drop between the nozzles when the pressurized ink material passes through the nozzles. For this reason, even if the same pressure acts on the ink material in the ink cavity, a small ink droplet is ejected from the nozzle which has a larger fluid resistance, while a large ink droplet is ejected from the nozzle which has a smaller fluid resistance. Therefore, by suitably changing the head portions ejecting ink droplets in response to an image signal, a high quality halftone image having a smooth, wide-range and multi-step gradation can be obtained.

Another ink-jet recording head of the present invention comprises a plate having first and second nozzles. The first and/or second nozzle have a coating which covers an inner surface thereof so that the first and second nozzles have different diameters.

With this ink-jet recording head, by covering an inner surface of a through-hole for the first and/or second nozzles with a coating, the diameters of the first and second nozzles are different from each other so that all through-holes for these nozzles can be formed into the same size. Also, the process for covering the inner surface of the nozzle with the coating may be performed for many nozzle plates at the same time. Therefore, the machining process of the nozzles can be simplified, which results in an effective and inexpensive manufacturing.

Another ink-jet recording head of the present invention comprises a plate having first and second nozzles. An inner diameter of the first nozzle is enlarged outwardly while an inner diameter of the second nozzle is narrowed outwardly.

With an ink-jet recording head of the present invention, a cross section of the first nozzle is widened outwardly while a cross section of the second nozzle is narrowed outwardly. As a result, the first nozzle has a configuration that the second nozzle is turned upside down. Thus, by turning over a nozzle plate having a nozzle of such cross section, the same shaped nozzle can be employed for both the first and second nozzles. Also, when the first and second nozzles are provided for one member, they can be formed from a upper side or a lower side of the member by use of a same machining means, respectively. Therefore, according to the invention, it is not necessary to change a diameter of laser beam and exchange a cutting tool for forming the first and second nozzles, which results in simplifying the machining process of nozzle, realizing an increased productivity and an inexpensive product.

BRIEF DESCRIPTION OF THE INVENTION

The present invention will be further described with reference to the accompanying drawings wherein like reference numerals refer to like parts in the several views, and wherein.

PREFERRED EMBODIMENT OF THE INVENTION

Figure 1:
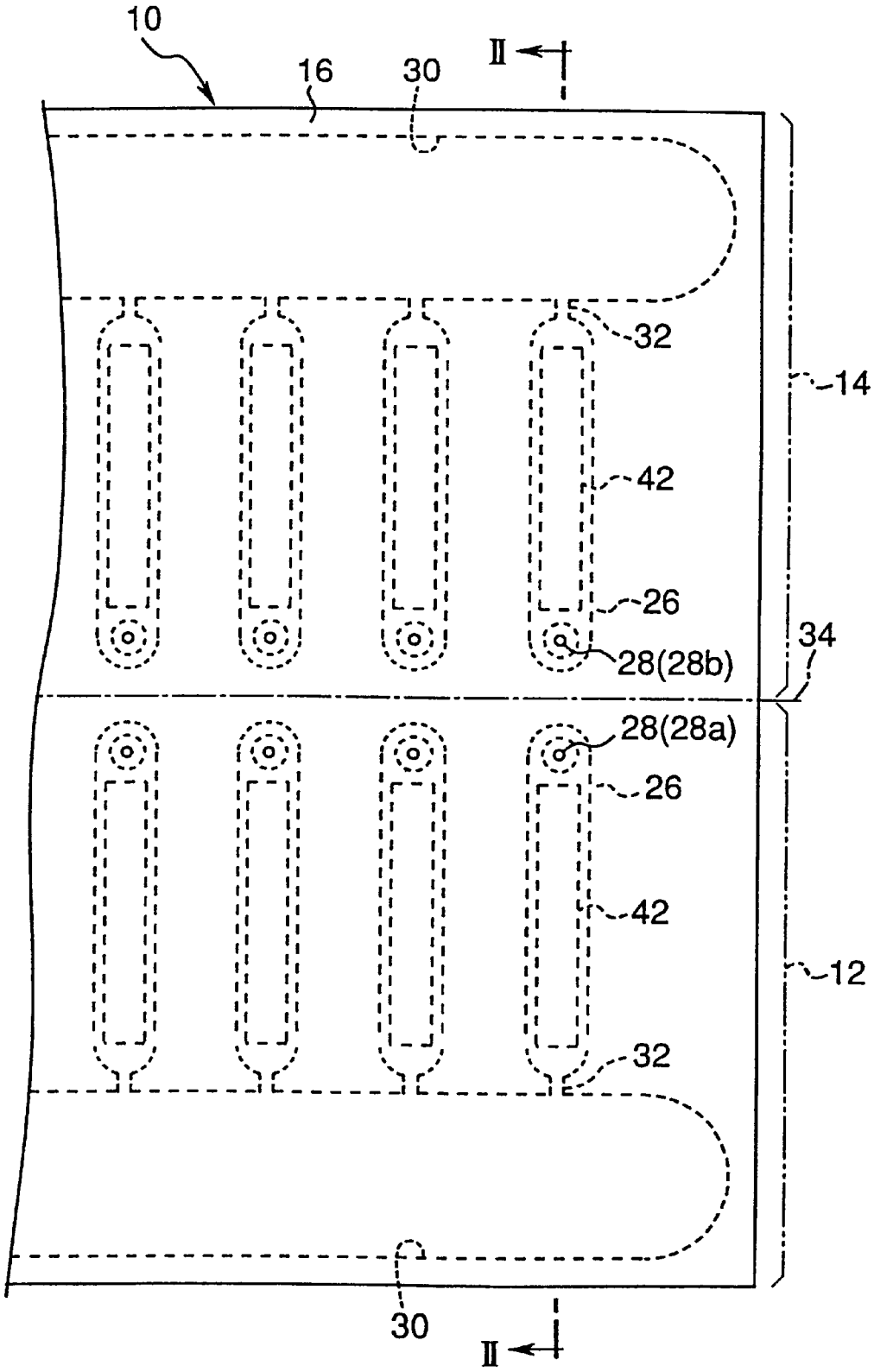
FIG. 1 is an enlarged partial plan view of an ink-jet recording head of the invention.
Figure 2:
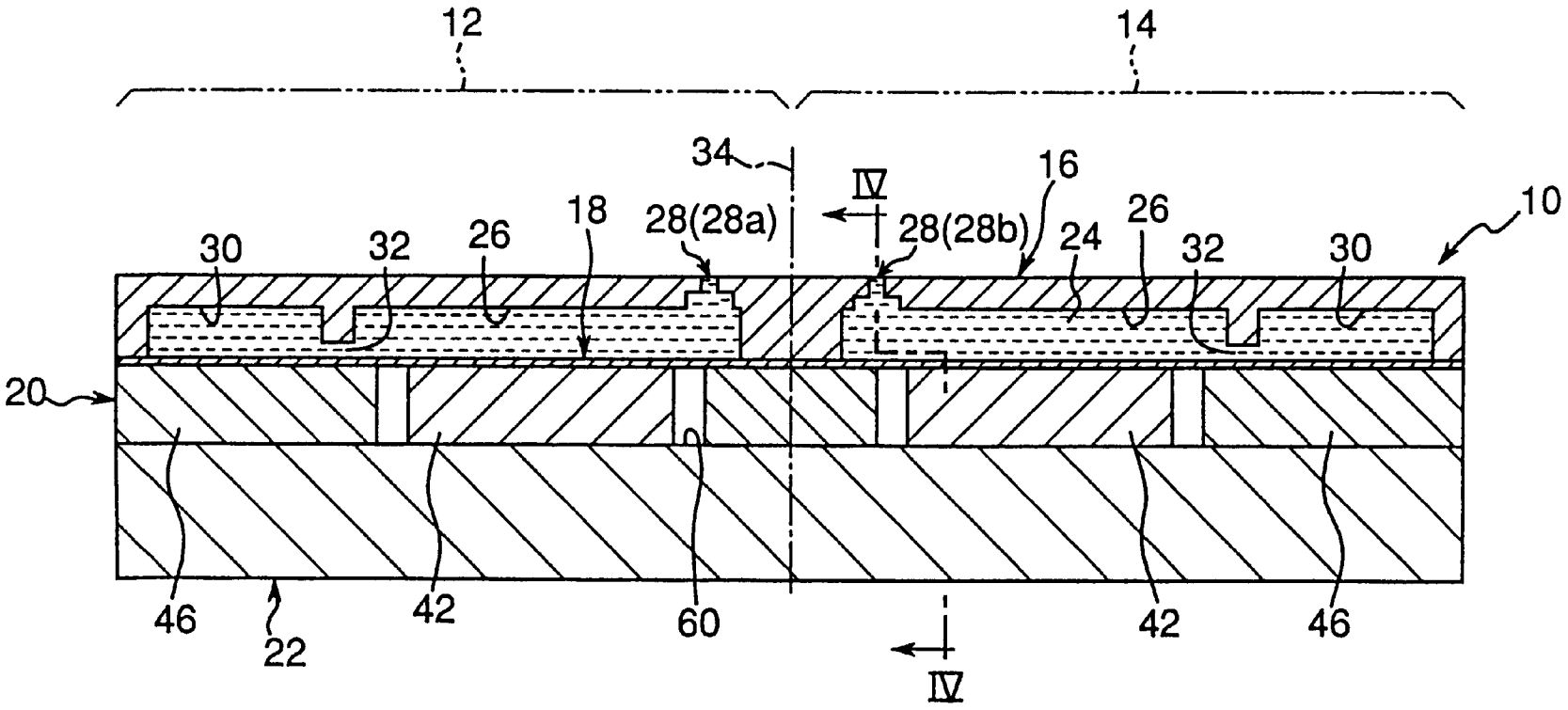
FIG. 2 is an enlarged cross-sectional side elevational view of the ink-jet recording head taken along the line II—II in FIG. 1.

Referring to the drawings, particularly FIGS. 1 and 2, an ink-jet recording head generally indicated by reference numeral 10 comprises a first head portion 12 for ejecting a large-diameter ink droplet and a second head portion 14 for ejecting a small-diameter ink droplet. The first and second head portions are formed integrally by a lamination of a cover plate 16, a diaphragm 18, a vibration plate 20, and a base plate 22.

The cover plate 12 is made of a metal, a synthetic resin or the like, and is formed at one surface confronting to the diaphragm 18 and includes a plurality of ink cavities 26 for receiving an ink material 24, ink supply chambers 30 for supplying the ink material 24, and ink inlets 32 which provide a communication path between the ink cavities 26 and the ink supply chambers 30. The first and second head portions also include nozzles 28 for ejecting the ink material 24 in the ink cavities 26 in each of the first head portion 12 and second head portion 14. The nozzles are formed by electroforming or photolithography. Hereinafter, the nozzles 28 of the first head portion 12 and second head portion 14 are suitably distinguished from each other by providing respective reference numerals 28*a* and 28*b* therefor.

Preferably, the ink cavities 26 in the first and second head portions 12 and 14 are in the form of grooves extending in a direction along which the head portions 12 and 14 oppose. The ink supply chambers 30 are located adjacent to the ink cavities 26 but away from a centerline 34, and connected to an ink tank not shown.

Figure 3A:
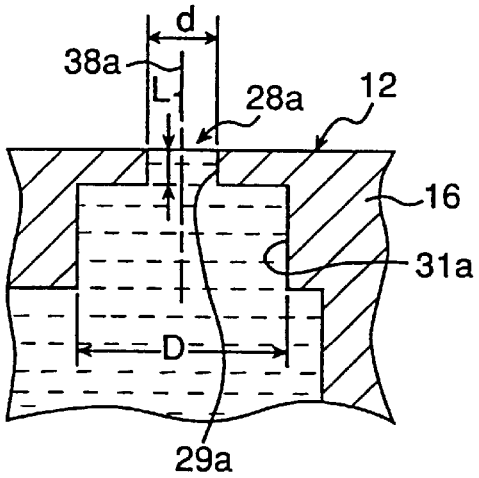
FIG. 3A is an enlarged cross-sectional view of stepped nozzle of the head portion for ejecting a large ink droplet.

Also, each of the nozzles 28*a* and 28*b* in the first and second head portions 12 and 14 is configured so that the inner diameter is reduced in steps toward the distal end of the nozzle. More specifically, as shown in FIG. 3A, the nozzle 28*a* has an inner nozzle portion 31*a* having an inner diameter of D and an outer nozzle portion 29*a* having an inner diameter of d which is smaller than D. Also, the nozzle 28*a* is sized so that the length $L_1$ of the outer nozzle portion 29*a* with respect to an axis of the nozzle 28*a* is shorter than that of the inner nozzle portion 31*a*.

Figure 3B:
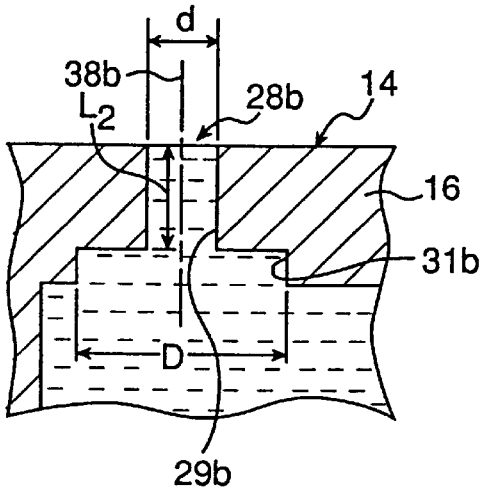
FIG. 3B is an enlarged cross-sectional view of the stepped nozzle of the head portion for ejecting a small ink droplet.
Figure 3C:
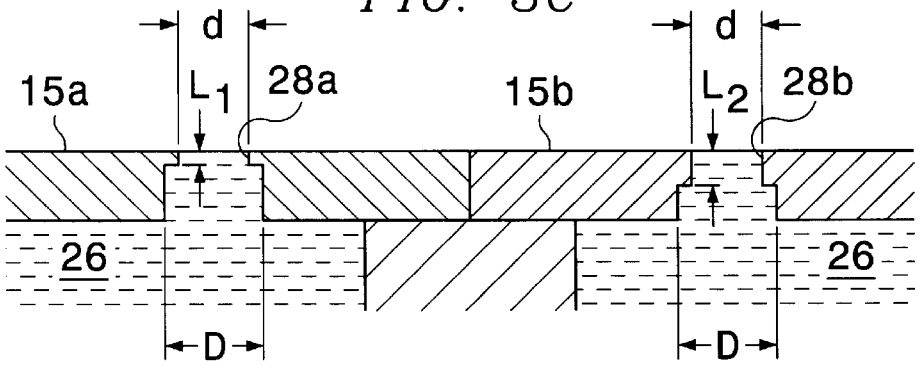
FIG. 3C is a cross sectional view of an ink-jet recording head showing first and second head portions with different stepped nozzles.

Likewise, as shown in FIG. 3B, the nozzle 28*b* in the second head portion 14 has an inner nozzle portion 31*b* having an inner diameter of D and an outer nozzle portion 29*b* having an inner diameter of d which is smaller than D. However, the nozzle 28*b* is sized so that the length $L_2$ of the outer nozzle portion 29*b* with respect to an axis of the nozzle 28*b* is longer than that of the inner nozzle portion 31*b*. An ink-jet head having first and second head portions as described above is shown in FIG. 3C.

With nozzles as described above, the fluid resistance that acts on the ink material moving past the outer nozzle portion depends on the length L and the area (given by the equation: $d\pi \times L$) of the outer nozzle portion. Accordingly, ink material to be ejected from the nozzle 28*b* will experience greater fluid resistance than that from nozzle 28*a*.

Referring again to FIG. 2, the diaphragm 18 is made from a thin film of a metal or from a synthetic resin or the like, and is fixed between the cover plate 16 and vibration plate 20. Preferably, the diaphragm 18 is stretched at a predetermined tension in its fixed position.

Figure 4:
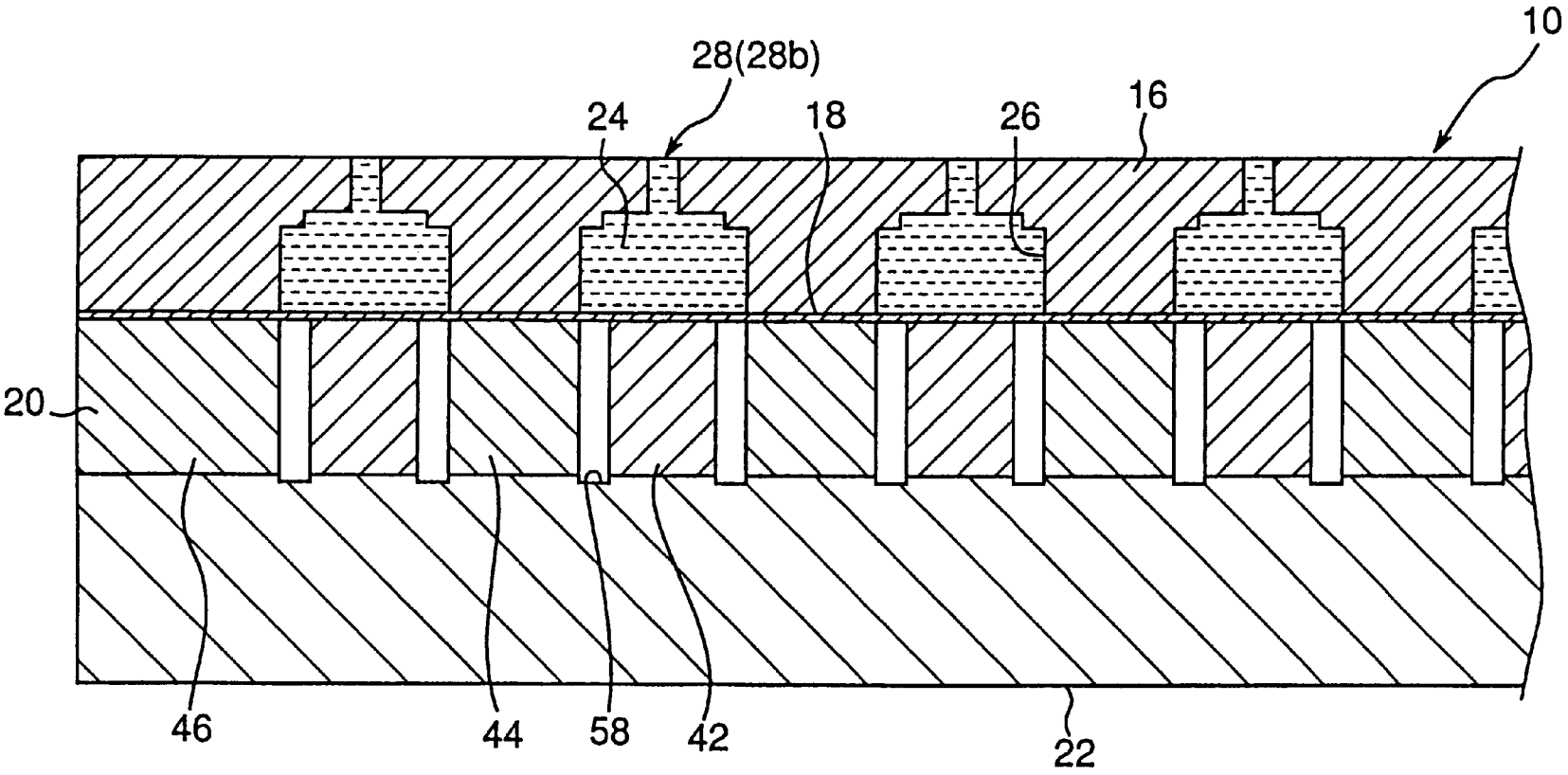
FIG. 4 is an enlarged cross-sectional side elevational view of the ink-jet recording head taken along the line IV—IV in FIG. 2.

The vibration plate 20, which is made of a piezoelectric material known in the art, is provided with conductive metal layers on the upper and lower surfaces (not shown) for use as common electrodes and individual electrodes, respectively. The vibration plate is fixed between the diaphragm 18 and base plate 22. As shown in FIGS. 2 and 4, the vibration plate 20 is divided by the formation of longitudinal grooves 58 and transverse grooves 60 by a dicing process, and separated into piezoelectric members 42 (i.e., pressurizing members) corresponding to ink cavities 26, partition walls 44 located between adjacent piezoelectric members 42 and walls 46 surrounding the piezoelectric members 42 and partition walls 44. The piezoelectric members 42 are polarized during manufacturing by the application of a voltage between common electrodes and individual electrodes while the piezoelectric member is held at a high temperature. Alternatively, instead of the singlelayer piezoelectric member, a multi-layered piezoelectric member in which a plurality of piezoelectric sheets and metal electrode layers are alternately layered may be employed.

The base plate 22 is made of a ceramic, a metal, synthetic resin or the like, and is fixed to the vibration plate 20.

The ink material 24 is supplied to the ink supply chamber 30 from the ink tank not shown. The ink material 24 in the ink supply chamber 30 is then distributed to each ink cavity 26 through the associated ink inlet 32. When a voltage (i.e., image signal) is applied between the common electrode and individual electrode from an image signal control circuit (not shown), the piezoelectric member 42 rapidly deforms. With the deformation of the piezoelectric member 42, the diaphragm 18 is forced into the ink cavity 26 pressurizing the ink material 24 in the ink cavity 26, and an ink droplet is thus ejected through the nozzle 28.

In the present embodiment, the piezoelectric members 42 in the first and second head portions 12 and 14 have the same size. Therefore, when applying a certain voltage to the piezoelectric member 42, the pressure acting on the ink material 24 in the ink cavity 26 by the deformation of the piezoelectric member 42 is constant. As described above, however, the fluid resistance from the nozzle 28*a* in the first head portion 12 is less than that from the nozzle 28*b* in the second head portion 14. Due to this, the pressure drop of the pressurized ink material passing through the nozzle 28*a* is smaller than that through the nozzle 28*b*, and thereby the ink droplet ejected from the nozzle 28*a* is larger than that ejected from the nozzle 28*b*. Thus, by suitably selecting the first head portion 12 or second head portion 14 and varying the voltage to be applied to the piezoelectric member 42 in response to the image signal, a smooth, wide-range, halftone gradation can be reproduced, which results in obtaining a high quality halftone image like a photograph.

Although the outer nozzle portions 29*a* and 29*b* of the nozzles 28*a* and 28*b* have the same diameter d in the previous embodiment, the diameter of the outer nozzle portion 29*a* of the nozzle 28*a* may be larger than that of the outer nozzle portion 29*b* of the nozzle 28*b*. In this case, a range of tone gradation can be extended widely.

Figure 5A:
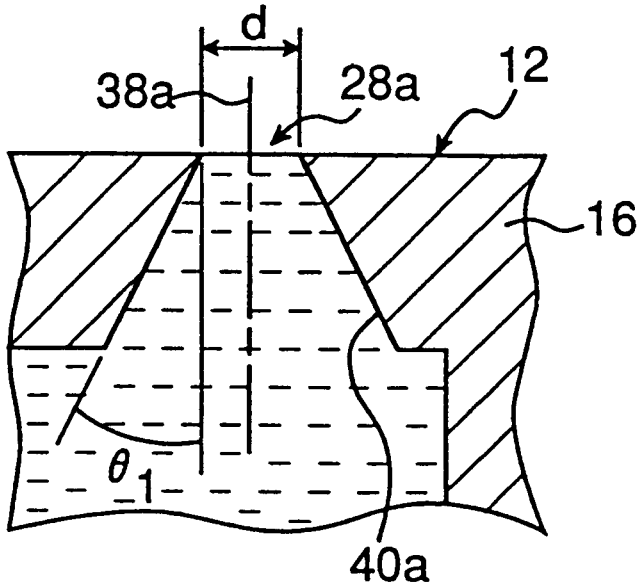
FIG. 5A is an enlarged cross-sectional view of a tapered nozzle for ejecting a large ink droplet.
Figure 5B:
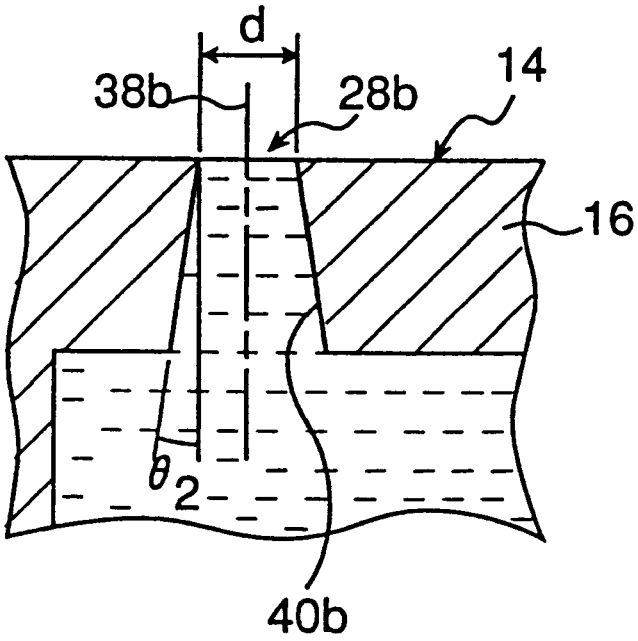
FIG. 5B is an enlarged cross-sectional view of a tapered nozzle for ejecting a small ink droplet.

Although the nozzle is stepped in the previous embodiment, it may alternatively be tapered toward the distal end thereof. Specifically, as shown in FIGS. 5A and 5B, the ink-jet recording head of this embodiment has a cover plate having tapered nozzles. The nozzle 28*a* in the first head portion 12 (illustrated in FIG. 5A) is tapered so that the inner surface 40*a* inclines at an angle of $\theta_1$ with respect to an axis 38*a* of the nozzle, while the nozzle 28*b* in the second head portion 14 (illustrated in FIG. 5B) is tapered so that the inner surface 40*b* inclines at an angle of $\theta_2$ with respect to an axis 38*b* of the nozzle. Also, to allow the nozzles 28*a* in the first head portion 12 to eject larger ink droplets than those ejected from the nozzles 28*b* in the second head portion 14, the taper angle $\theta_1$ is designed to be larger than $\theta_2$ and thereby providing the nozzle 28*a* with a lower fluid resistance than that of nozzle 28*b*.

Figure 6:
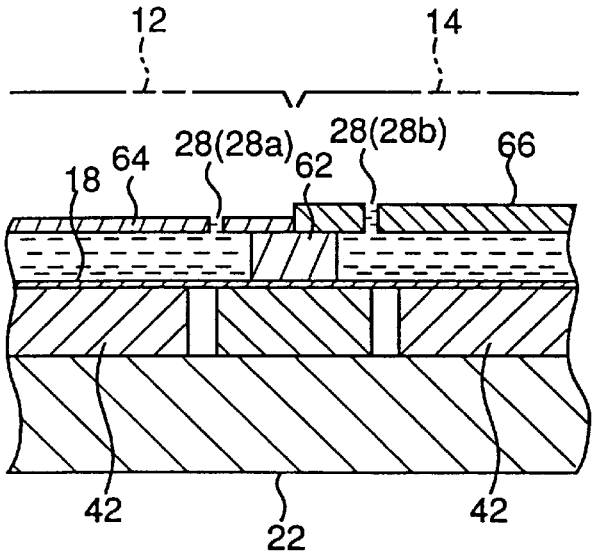
FIG. 6 is an enlarged partial cross-sectional side elevational view of a modified ink-jet head in which two head portions are covered with nozzle plates having different thicknesses, respectively.

As shown in FIG. 6, the nozzle may be a straight through hole having a constant diameter from its proximal end to distal end. In this case, the lengths of the nozzles 28 and 28*b* for the first and second head portions 12 and 14 may be different from each other. This can be achieved by providing two cover plates 64 and 66 having different thicknesses for the first and second head portions 12 and 14. Due to the difference of the thicknesses, i.e., lengths of the nozzles, the nozzle 28*a* in the first head portion 12 will provide the ink material to be ejected with greater fluid resistance than the nozzle 28*b* in the second head portion 14, causing the nozzle 28*a* in the first head portion 12 to eject larger ink droplets than those ejected through the nozzle 28*b* in the second head portion 14.

Several tests were conducted and are described below.

Figure 7A:
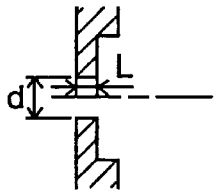
FIG. 7A illustrates a nozzle where a length of an outer portion is designated L.
Figure 7B:
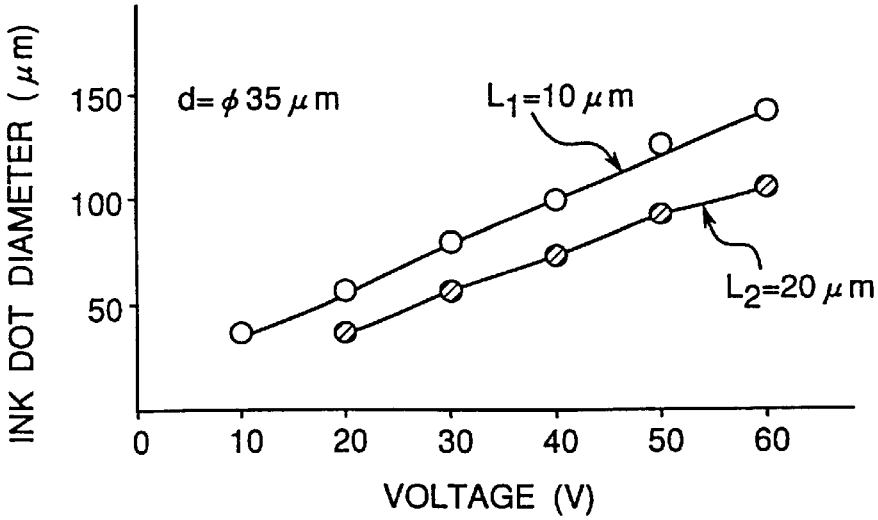
FIG. 7B is a graph showing a relationship between a voltage applied to piezoelectric member and a diameter of ink dot formed by ink ejection in the case where a length of an outer nozzle portion of the nozzle is changed.

Test 1: The nozzle plate was prepared with a stepped nozzle. The stepped nozzle 28*a* for the first head portion 12 was configured so that the outer nozzle portion 29*a* had an inner diameter of 35 $\mu$m and a length $L_1$ of 10 $\mu$m, while the stepped nozzle 28*b* for the second head portion 14 was configured so that the outer nozzle portion 29*b* had an inner diameter of 35 $\mu$m and a length $L_2$ of 20 $\mu$m. Various voltages from 10 V (or 20 V) to 60 V were applied to the piezoelectric members and the diameters of ink dots formed on the recording medium were measured. The result is graphed in FIG. 7 which shows that the ink dots formed by the first head portion 12 have larger diameters than those formed by the second head portion 14 at each voltage level.

Figure 8:
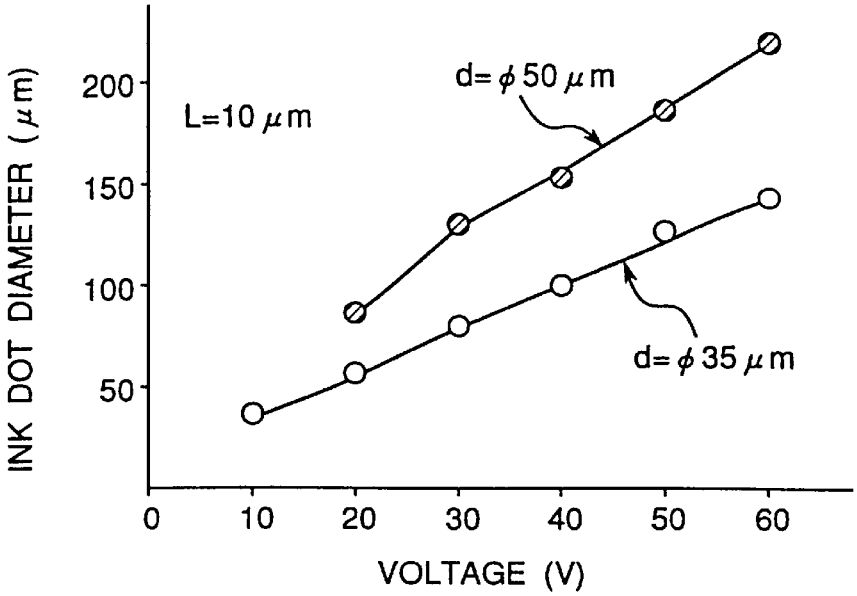
FIG. 8 is a graph showing a relationship between a voltage applied to piezoelectric member and a diameter of ink dot formed by ink ejection in the case where a length of the outer nozzle portions of the nozzles are constant while diameters thereof are different from each other.

Test 2: Stepped nozzles 28*a* and 28*b* having the inner diameters of 50 $\mu$m and 35 $\mu$m at their outer nozzle portions 29*a* and 29*b* were formed for the first and second head portions 12 and 14 while the outer head portions 29*a* and 29*b* had a constant length of 10 $\mu$m. Other conditions were the same as those of Test 1. The result is graphed in FIG. 8 which shows that the diameters of the ink droplets, and resultant dots, increases depending on the diameter of the outer nozzle portion. It can be seen from the graph that the tone gradation can be expanded by the use of stepped nozzles each having individual length and/or diameter at its distal end.

Figure 9A:
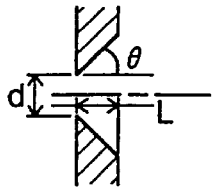
FIG. 9A illustrates a nozzle with taper angles.
Figure 9B:
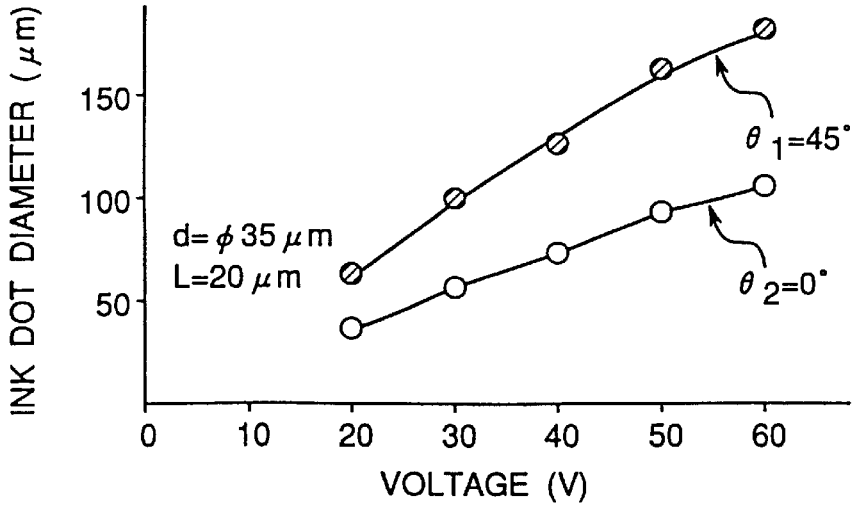
FIG. 9B is a graph showing a relationship between a voltage applied to piezoelectric member and a diameter of ink dot formed by ink ejection in the case where taper angles of inner surfaces of the nozzles with respect to central axes thereof are different from each other.

Test 3: A similar test was conducted for the ink-jet recording head having tapered nozzles. A nozzle plate having a thickness of 20 $\mu$m was provided where each nozzle formed in the first and second head portions had a diameter of 35 $\mu$m at its distal end. Also, the tapered nozzles in the first and second head portions 12 and 14 had taper angles of 45° and 0°, respectively, and a constant length of 20 $\mu$m. The voltage applied to the piezoelectric member was changed from 20 V to 60 V at 10 V intervals. The ink dots formed on the recording medium were measured. The result is graphed in FIG. 9. This graph shows that the tapered nozzle in the first head portion 12 has less fluid resistance against the ink material and therefore it can form larger ink dots than the tapered nozzle in the second head portion 14.

Figure 10:
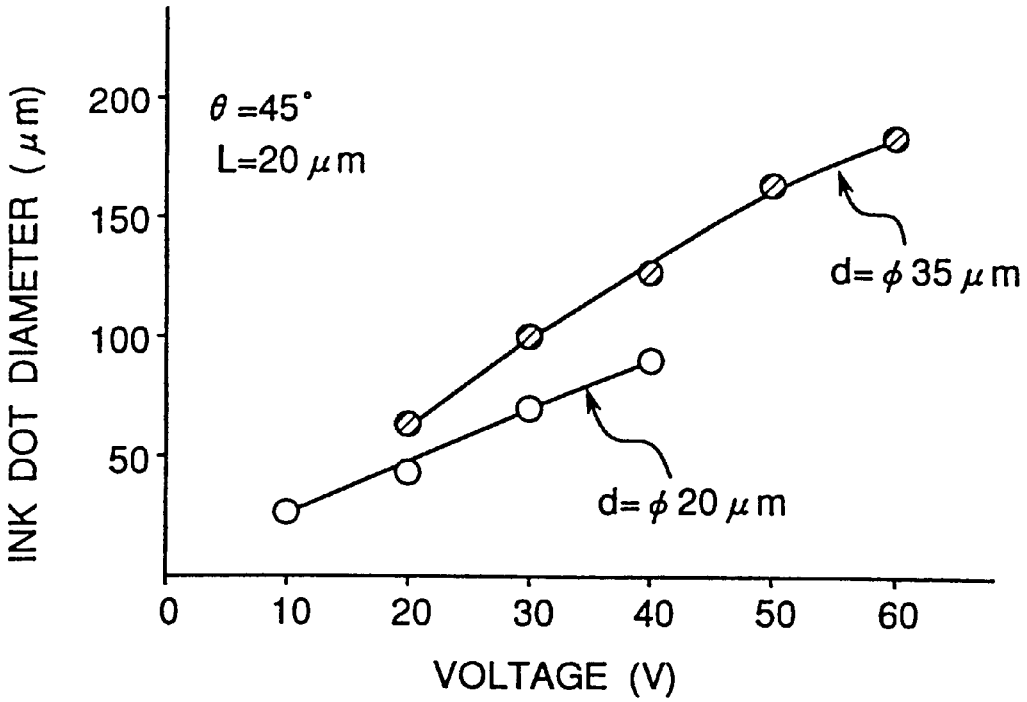
FIG. 10 is a graph showing a relationship between a voltage applied to piezoelectric member and a diameter of ink dot formed by ink ejection in the case where the taper angles of the inner surfaces of the nozzle are constant while diameters of the ejection ports thereof are different from each other.

Test 4: Tapered nozzles having a taper angle of 45° and a length of 20 $\mu$m were formed in the first and second head portions 12 and 14. The only difference between the first and second head portions was the diameter of the nozzle and the first and second nozzle plate were formed with tapered nozzles having diameters of 35 $\mu$m and 20 $\mu$m, respectively. The dot diameters were measured, but the ink material was scattered when the voltages of 50 V and 60 V were applied for the second head portion 14 and no ink dot was formed. The result is graphed in FIG. 10. FIG. 10 shows that larger ink dots can be formed with the increase of the nozzle size at each voltage. Therefore, from the above tests 3 and 4, a wide tone gradation can be obtained by the use of tapered nozzles each having individual taper angle and/or diameter at its distal end.

Figure 11:
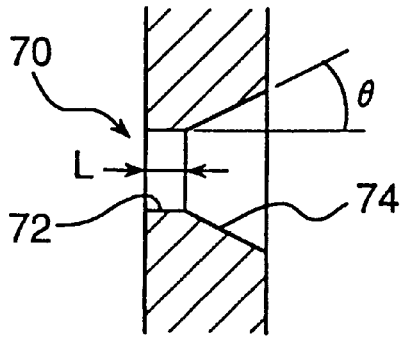
FIG. 11 is an enlarged cross-sectional view of a modification of the nozzle.

The cross sectional configuration of the nozzle is not limited to those described above, and it can be other configurations. For example, a nozzle that has a tapered portion on its inner side and cylindrical portion on its outer side as shown in FIG. 11. In this instance, the length of the cylindrical portion and/or the taper angle of the tapered portion in one head portion can be differed from the other head portion, increasing the tone gradation of the resultant image and thereby reproducing a picture-like smooth gradation image.

Although only two head portions are mounted in one ink-jet recording head, three or more head portions may be provided for the ink-jet recording head.

Figure 12:
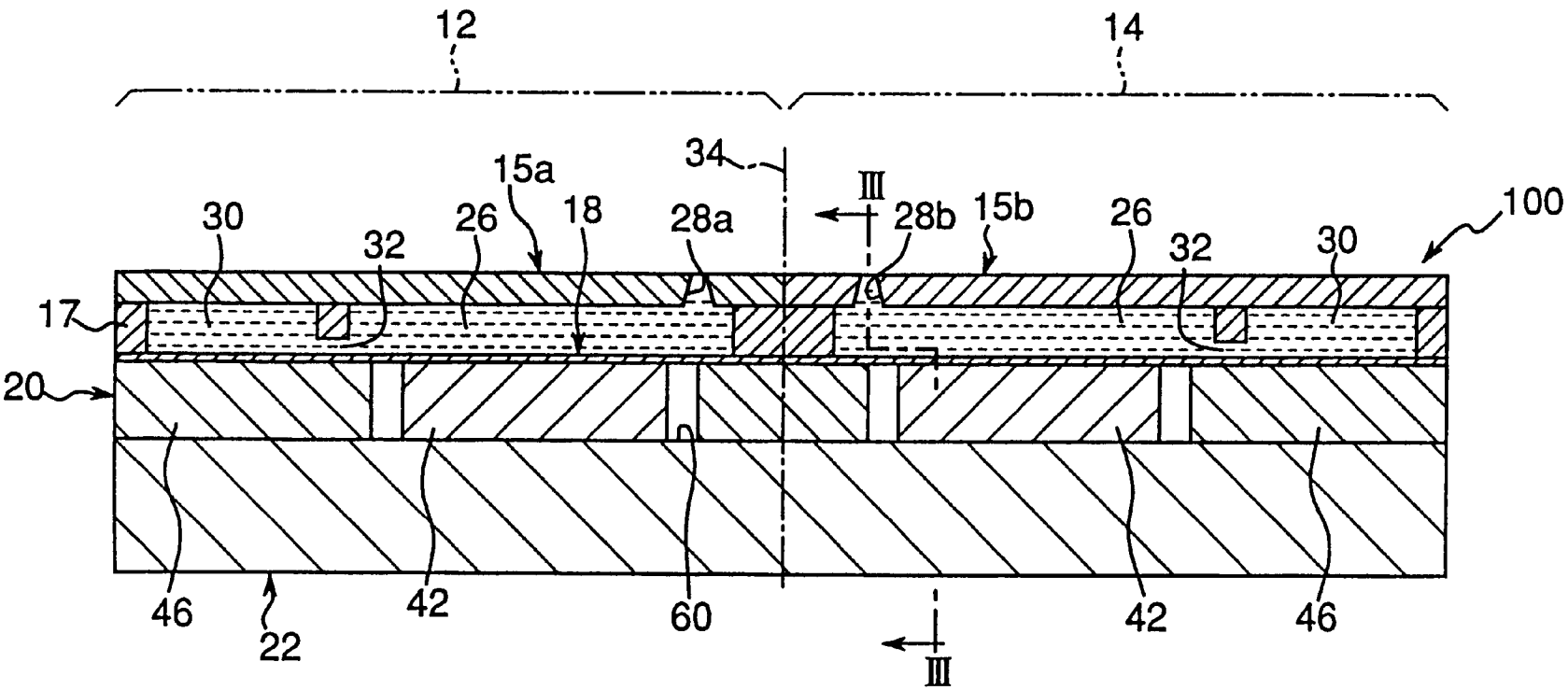
FIG. 12 is an enlarged cross-sectional side elevational view of another ink-jet recording head in which the cover plates is constructed of two plates corresponding to first and second head portions.

Another ink-jet recording head of the invention will be described next. Referring to FIG. 12, the ink-jet recording head generally indicated by reference numeral 100 comprises the cover plate which is constructed by a plurality of members, i.e., nozzle plate 15a for the first head portion 12, nozzle plate 15*b* for the second head portion 14 and cavity forming member 17.

The cavity forming member 17 forms a plurality of spaces, or grooves for the ink cavities 26, ink supply chambers 30, and ink inlets 32 for the first and second head portions 12 and 14, respectively. The nozzle plates 15*a* and 15*b* are fixed adjacent to each other on an upper surface of the cavity forming member 17 to cover the ink cavities 26, ink supply chambers 30, and ink inlets 32. The nozzle plates 15*a* and 15*b* have a plurality of large-diameter and small-diameter nozzles 28*a* and 28*b*, respectively. The nozzles 28*a* and 28*b* are generally in the form of a truncated cone and a diameter of the ejection port of the nozzle 28*a* is formed to be larger than that of the nozzle 28*b*. The other structures of the head 100 except the nozzle plates 15*a* and 15*b* and cavity forming member 17 are similar to those of the ink-jet recording head 10 described above.

The nozzle plates 15*a* and 15*b* are formed according to the steps shown in FIGS. 13A to 13F. First, a photoresist layer 72 having a thickness of, e.g., 20 μm, is formed on a release layer (not shown) at one surface of a base plate 70 and then ultraviolet rays are exposed to the photoresist layer 72 through a photomask 74. The photomask 74 has a plurality of openings 76 arranged in a row, having a diameter of, e.g., 35 μm.

Figure 13A:
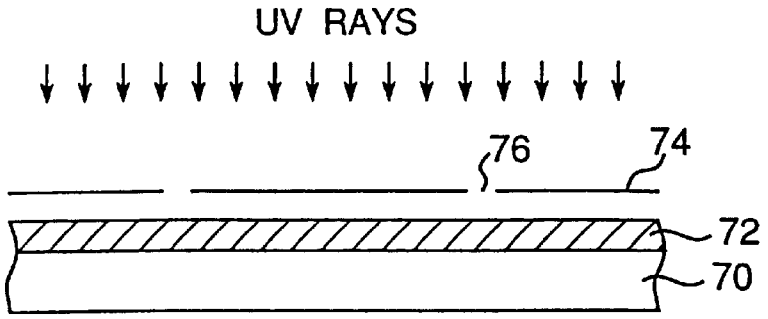
FIGS. 13A to 13F show the steps for manufacturing the nozzle plate.
Figure 13B:
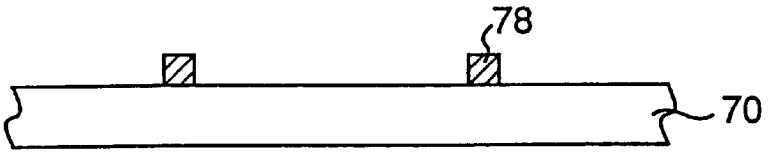

After exposure, the base plate 70, together with the photoresist layer 72, is immersed in a developer liquid for developing. The portions 78 of the photoresist layer 72 are insoluble against the developer liquid by the exposure of the ultraviolet rays through the openings 76 of the photomask 74. For this reason, as shown in FIG. 13B, the photoresist layer 72, except the portions 78, is dissolved and removed by the developer liquid so that column-like portions 78 still remain on the base plate 70.

Figure 13C:
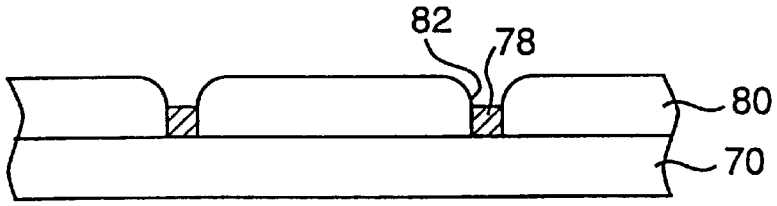

After development, as shown in FIG. 13C, a thin layer 80 of a thickness of, e.g., 80 μm, preferably made of nickel, is formed on a surface of the base plate 70 by electroplating. The thin layer 80 will form the nozzle plates 15*a* and 15*b*. The portions 78 have no electrical conductivity so that the upper surfaces of the portions 78 are not covered with the plating material, and thereby through-holes 82 are formed in the thin layer 80 in correspondence with the portions 78. The through-holes 82 have the same diameter (e.g., 35 μm) as the openings 76 of the photomask 74 and will form the nozzles 28*a* and 28*b*. Although the material of the base plate 70 is not limited to a specific material, the base plate is preferably made of brass because the nickel plating layer can readily be removed therefrom.

Figure 13D:
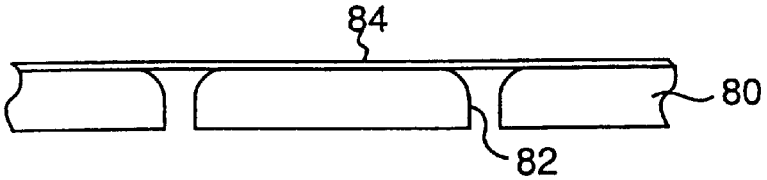
Figure 13E:
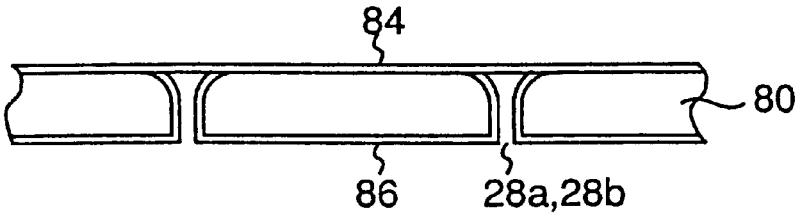

After the thin layer 80 has been removed from the base plate 70, the thin layer 80 is immersed in a solvent to dissolve the portions 78. Then, as shown in FIG. 13D, a tape 84 is attached on an upper surface (a surface of the nozzle plates 15*a* and 15*b* confronting to the ink cavity) of the thin layer 80 and thereby masks the surface. Next, using a nickel plating solution which includes fluorine, a surface of the thin layer 80 is plated with nickel by a eutectoid plating so that, as shown in FIG. 13E, a nickel coating 86 which includes fluorine is formed on inner surfaces of the through-holes 82 and the outer surface of the thin layer 80.

Figure 13F:
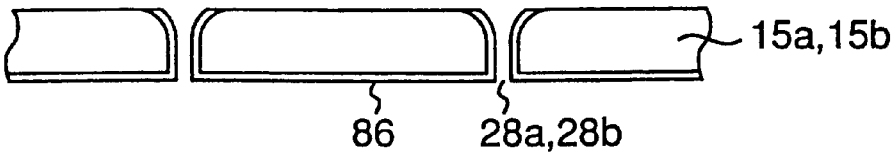
Figure 13G:
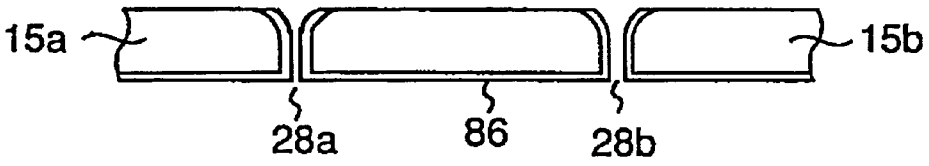
Figure 13H:
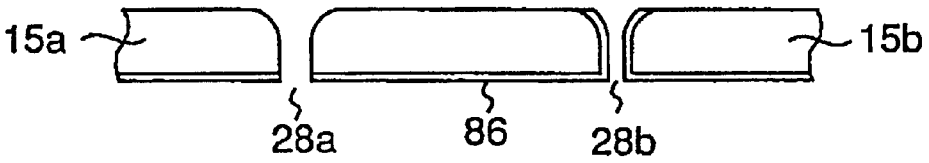

By providing different thicknesses of the coating 86 for the nozzle plates 15*a* and 15*b*, large-diameter nozzles 28*a* and small-diameter nozzles 28*b* which have different inner diameters are formed in the nozzle plates 15*a* and 15*b*, respectively. For example, when the inner diameter of the through-hole 82 is 35 μm, the large-diameter nozzle 28*a* having the inner diameter of 33 μm is formed for the nozzle plate 15*a* with its surface covered by the coating 86 having the thickness of 1 μm, while the small-diameter nozzle 28*b* having the inner diameter of 25 μm is formed for the nozzle plate 15*b* with its surface covered by the coating 86 having the thickness of 5 μm. Finally, as shown in FIG. 13F, the tape 84 is peeled off and thereby the nozzle plates 15*a* and 15*b* are obtained.

As described above, according to the invention, different diameters can be provided for the nozzles of the first and second head portions simply by forming coatings having different thicknesses, respectively. Therefore, it is not necessary to form through-holes having different diameters in the plate, instead the plate may be provided with through-holes 82 for the nozzles 28*a* and 28*b* that have the same diameter. Also, a machining process is not required to form the nozzles which thereby facilitates the production of the nozzle plate. Further, since the process for covering the inner surfaces of the through holes with the coating is performed for many nozzle plates at the same time, it is simple which results in an effective and inexpensive manufacturing process. Although the material of the coating 86 is not limited to a specific material, preferably a material having a high repellency against the ink material is employed.

Figure 14:
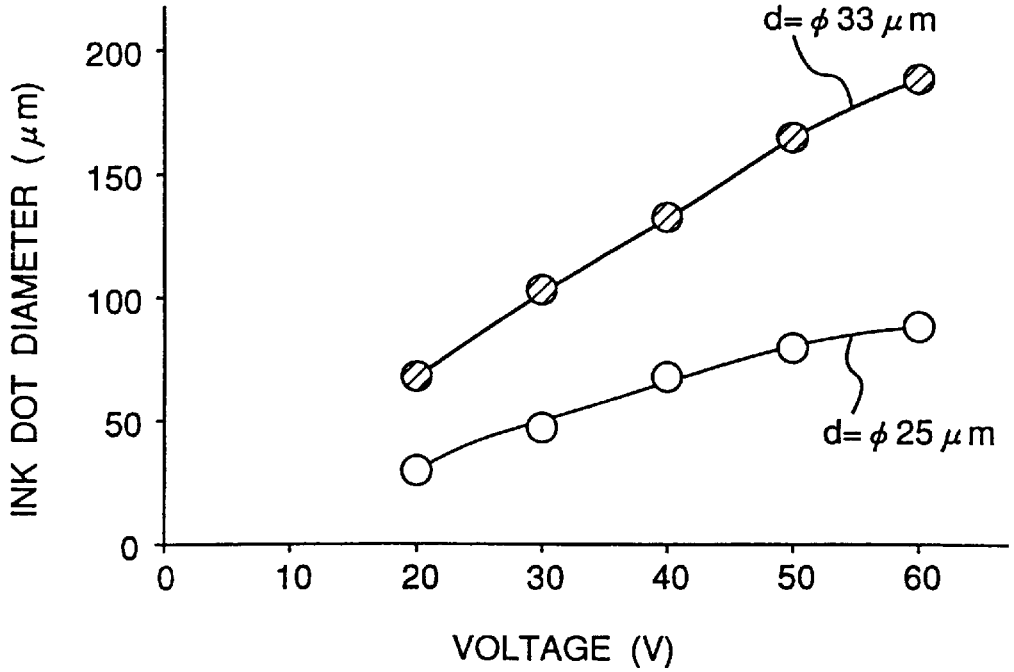
FIG. 14 is a graph showing a variation of a diameter of ink dots formed by ink ejection in the case where a voltage applied to a piezoelectric member is changed.

A test was conducted to evaluate the ink dot diameters formed on the recording medium. The nozzle plates were provided in which nozzles having diameters of 33 μm and 25 μm for the first and second head portions 12 and 14, respectively, were formed. Multi-layered piezoelectric members consisting of 20 piezoelectric sheets each having a thickness of 35 μm were employed. The voltage applied to the piezoelectric members was changed from 20 V to 60 V at 10 V intervals. A stainless steel film (SUS#304) having a thickness of 6 μm was provided for the diaphragm. The recording medium was obtained under the trade designation "Sharp Coat Paper ST-70A4". The ink material was obtained under the trade designation "MAT-1002" from Dainippon Ink Chemicals, Inc. The ink dots formed on the recording medium were measured and the results are graphed in FIG. 14. It can be seen from FIG. 14 that the diameter of the ink dots formed by the first head portion 12 range from about 60 μm to 180 μm while the diameter of the ink dots formed by the second head portion 14 range from about 30 μm to 85 μm.

Thus, according to the ink-jet recording head of the invention, by suitably selecting the first and second head portions and varying the voltage to be applied to the piezoelectric member 24 in response to the image signal, the diameter of the ink dot can be changed stably in a wide range. As a result, a smooth, wide-range and multi-step gradation can be provided on the resultant image and a high quality halftone image like a photograph can be obtained.

Although, in the ink-jet recording head 100 of the invention, the coating is formed on the inner surfaces of the large-diameter and small-diameter nozzles 28*a* and 28*b*, through-hole having no coating may be used for the large-diameter nozzle, while the through-hole having the same diameter as the large-diameter nozzle but having the coating on the inner surface thereof may be used for the small-diameter nozzle. In this case, to form the large-diameter nozzle having no coating, in the process for producing the nozzle plate 15*a* for the first head portion 12, the portions 78 are eliminated by the solvent after covering the outer surface of the nozzle plate 15*a* with the coating 86 so that the coating is prevented to form on the inner surface of the through hole 82 for the large-diameter nozzle (see FIGS. 13C to 13E).

Also, the nozzle plate is not limited to a metal plate obtained by plating as described above instead, a thin plate made of resin such as polyimide resin may be employed for the nozzle plate. In this case, after a fluorine coating made from a plasma polymerization film is formed on a surface (surface of an ejection side) of the thin plate of resin by a plasma CVD process, the through-holes for the large-diameter nozzle are formed in the thin plate by a excimer laser beam, thereby obtaining the nozzle plate 15*a* for the first head portion 12. On the other hand, when producing the nozzle plate 15*b* for the second head portion 14, the thin plate for the nozzle plate 15*a* is covered with a fluorine coating by the same way so that the coating is formed on the inner surface of the through-hole having the same diameter as the large-diameter nozzle. The coating renders the inner diameter of the through-hole smaller, thereby the nozzle plate 15*b* having the small-diameter nozzle can be obtained.

Figure 15:
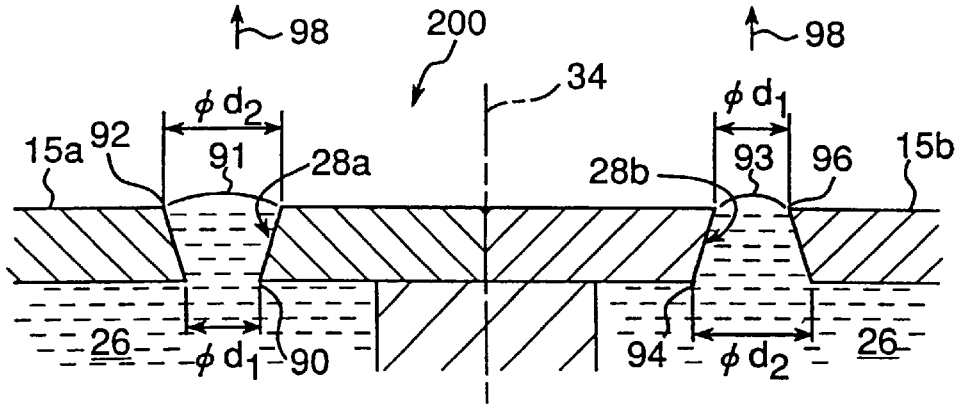
FIG. 15 is an enlarged cross-sectional view of first and second nozzles.

Referring to FIG. 15, another ink-jet recording head 200 of the invention will be described hereinafter. The ink-jet recording head 200 has the same construction as the ink-jet recording head 100 described above except for the configuration of the nozzles 28*a* and 28*b*.

More specifically, in the ink-jet recording head 200, the nozzle 28*a* is tapered inwardly so that an outer opening 92 is larger than an inner opening 90. Instead, the nozzle 28*b* is tapered outwardly so that an outer opening 96 is smaller than an inner opening 94. In addition, the outer opening 92 of the nozzle 28*a* and inner opening 94 of the nozzle 28*b* have the same diameter $d_2$ while the inner opening 90 of the nozzle 28*a* and the outer opening 96 of the nozzle 28*b* have the same diameter $d_1$.

Also, the nozzles 28*a* and 28*b* are symmetrically arranged with respect to a center line 34 defined between the nozzle plates 15*a* and 15*b*. Further, the nozzle plates 15*a* and 15*b* have the same thickness. Therefore, the same two plates can be used for the nozzle plates 15*a* and 15*b* simply by arranging one of two plates upside down.

With the head 200 so constructed, ink meniscuses 91 and 93 are formed in the nozzles 28*a* and 28*b*, respectively, as shown in FIG. 15. Surfaces of the ink meniscuses have the same size as the outer openings 92 and 96, respectively. Therefore, the ink meniscus 91 in the nozzle 28*a* has a larger surface area than the ink meniscus 93 in the nozzle 28*b*.

Thus, when a voltage is applied to the piezoelectric member 42 from the image signal control circuit (not shown), the piezoelectric member 42 deforms, the diaphragm 18 is forced into the ink cavity 26, and thereby the ink material in the ink cavity 26 is pressurized. Since the construction of the head portions 12 is the same as that of the head portion 14 except the nozzle, the same pressure acts on the ink material in the head portions 12 and 14 when the same voltage is applied to the piezoelectric member 42.

However, the diameter of the ink droplet ejected from the nozzle depends upon the shape of the nozzle, particularly upon the opening area of the nozzle, and because the opening area of the outer opening 96 of the nozzle 28*b* is smaller than that of the outer opening 92 of the nozzle 28*a*, the diameter of the ink droplet ejected from the nozzle 28*b* is more likely to be affected by surface tension of the ink meniscus 93 compared with the ink droplet from the nozzle 28*a*, and as a result, the ink droplet having a smaller diameter is ejected from the nozzle 28*b*.

Also, by varying the voltage applied to the piezoelectric member 42, the diameters of the ink droplets ejected from the nozzles 28*a* and 28*b* can be changed in different ranges, while keeping a stable ejection state of the ink droplet. Therefore, by suitably selecting the head portions 12 and 14 ejecting the ink droplet and varying the voltage to be applied to the piezoelectric member 42 in response to the image signal, a smooth, wide-range and multi-step gradation image can be printed.

A test was conducted to evaluate the ink dot diameters formed on the recording medium. Nozzle plates were provided in which nozzles each having a small diameter $d_1$ of 20 $\mu$m and a large diameter $d_2$ of 35 $\mu$m for the first and second head portions, respectively, were formed. Multi-layered piezoelectric members consisting of 20 piezoelectric sheets, each having a thickness of 35 $\mu$m, were employed. The voltage applied to the piezoelectric members was changed from 20V to 60 V at 10 V intervals. A stainless steel film (SUS#304), having a thickness of 6 $\mu$m, was provided for the diaphragm. The recording medium was obtained under the trade designation "Sharp Coat Paper ST-70A4". The ink material was obtained under the trade designation "MAT-1002" from Dainippon Ink Chemicals, Inc.

Figure 16:
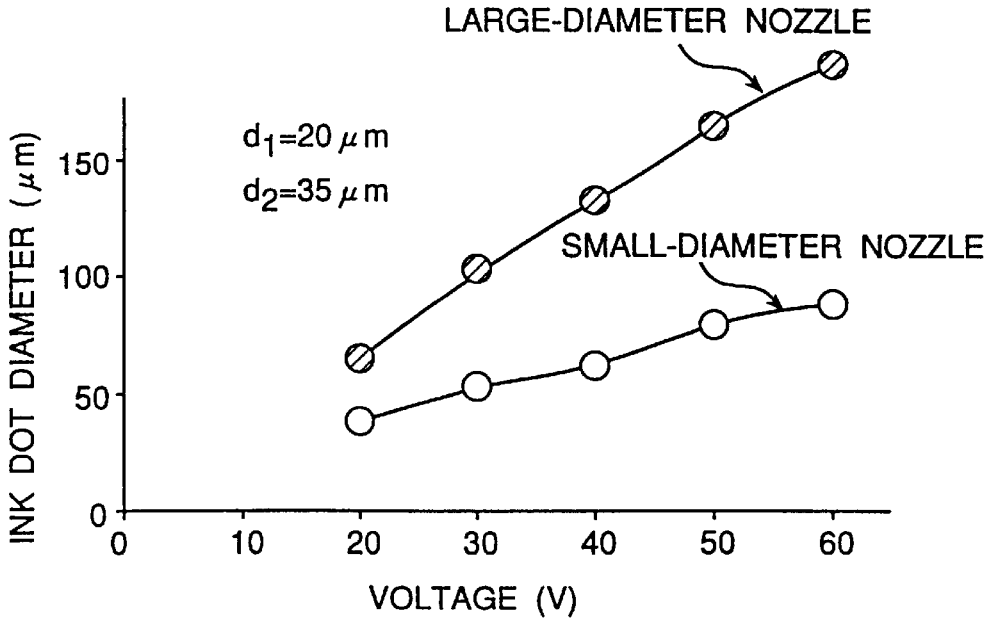
FIG. 16 is a graph showing a variation of a diameter of ink dots formed by ink ejection in the case where a voltage applied to a piezoelectric member is changed.

The ink dots formed on the recording medium were measured. The results are graphed in FIG. 16. It can be seen from FIG. 16 that the diameters of the ink dots formed by the large-diameter nozzle 28*a* of the first head portion 12 range from about 60 $\mu$m to 180 $\mu$m while the diameter of the ink dots formed by the small-diameter nozzle 28*b* of the second head portion 14 range from about 30 $\mu$m to 85 $\mu$m.

As described above, in the ink-jet recording head 200 of the invention, the nozzle 28*a* in the first head portion 12 is tapered inwardly and the nozzle 28*b* in the second head portion 14 is tapered outwardly so that the same two nozzle plates can be employed for the nozzle plates 15*a* and 15*b* simply by arranging one of two plates upside down. Therefore, it is not necessary to use a plurality of tools for forming nozzles in respective head portions and the machining process can therefore be simplified, which results in an increased productivity and an inexpensive product.

Figure 17:
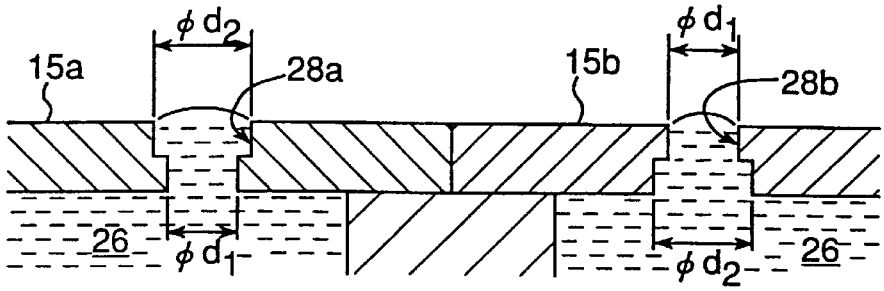
FIG. 17 is an enlarged cross-sectional side elevational view of first and second nozzles of another embodiment.
Figure 18:
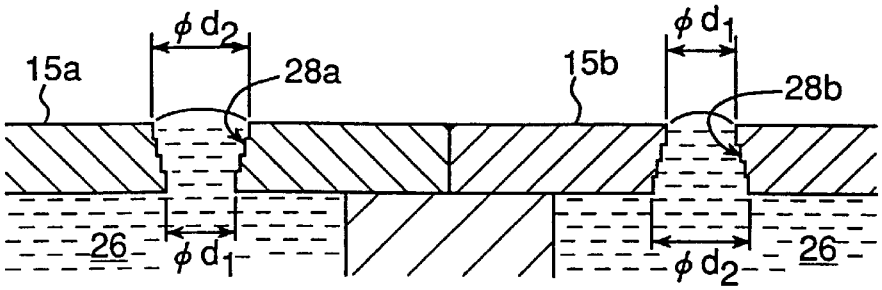
FIG. 18 is an enlarged cross-sectional side elevational view of first and second nozzles of yet another embodiment.

Although, in the ink-jet recording head 200, the nozzles 28*a* and 28*b* are tapered in different directions, another configuration may be applied to the nozzles. For example, as shown in FIGS. 17 and 18, the nozzle 28*a* for ejecting larger ink droplets is stepped so that the outermost diameter is larger than the innermost diameter while the nozzle 28*b* for ejecting smaller ink droplets is so stepped that the innermost diameter is larger than the outermost diameter.

Also, although the nozzle plates 15*a* and 15*b* and cavity forming member 17 are used for defining ink cavities, ink inlets and ink supply chambers, the ink cavities and the like may be formed in one member. In this case, the large-diameter and small-diameter nozzles 28*a* and 28*b* can be formed from upper and lower sides of the member by use of the same machining means, respectively.

Further, although in the ink-jet recording heads described above, the diaphragm is provided to keep the piezoelectric member out of contact with the ink material, the diaphragm may be eliminated therefrom. However the piezoelectric member may lose its ability of deformation if the ink material penetrates therein. Therefore, in this case, it is preferable that the surfaces of the piezoelectric member which may contact the ink material are covered with a coating to prevent the piezoelectric member from being in direct contact with the ink material.

Although, in the ink-jet recording heads of the invention, the piezoelectric member is used to pressurize the ink material in the ink cavity, the invention can equally be applied to a bubble jet recording head in which a heating element is used as the pressurizing means.

Although the present invention has been fully described by way of example with reference to the accompanying drawings, it is to be noted that various changes and modifications will be apparent to those skill in the art. Therefore, unless otherwise such changes and modifications depart from the scope of the present invention, they should be construed as being included therein.

What is claimed is:

1. An ink-jet recording head, comprising:

at least two head portions, each of said head portions including an ink cavity for receiving an ink material and means for pressurizing said ink material in said ink cavity; and a plate having first and second nozzles, each of said first and second nozzles corresponding to one of said head portions;

at least one of said first and second nozzles having a coating which covers substantially all of an inner peripheral surface thereof, said coating affecting an inner diameter of said at least one of said first and second nozzles so that said first and second nozzles have substantially different inner diameters.

2. An ink-jet recording head in accordance with claim 1, wherein coatings having different thicknesses are provided on substantially all of said inner peripheral surfaces of each of said first and second nozzles, respectively, so that said first and second nozzles have different inner diameters.

3. An ink-jet recording head in accordance with claim 2, wherein an inner diameter of said first and second nozzles is substantially equivalent before said coatings are provided.

4. An ink-jet recording head, comprising:

at least two head portions, each of said head portions including an ink cavity for receiving an ink material and means for pressurizing said ink material in said ink cavity; and a plate having first and second nozzles, said first nozzle having a coating which covers an inner surface thereof, said second nozzle being uncoated;

wherein said coating affects an inner diameter of said first nozzle so that an inner diameter of said first nozzle is not equivalent to an inner diameter of said second nozzle.

5. An ink-jet recording head comprising:

at least two head portions, each of said head portions including an ink cavity for receiving an ink material and means for pressurizing said ink material in said ink cavity; and a plate having first and second nozzles, an inner diameter of said first nozzle diverging in a direction of ink ejection while an inner diameter of said second nozzle converging in said direction of ink ejection;

wherein each of said first and second nozzles has a first nozzle portion having a first inner diameter and a second nozzle portion having a second inner diameter, said first and second inner diameters forming a stepped nozzle configuration.

6. An ink-jet recording head comprising:

a plurality of head sections, each of said head sections including an ink cavity for receiving an ink material, means for pressurizing said ink material in said ink cavity, and a nozzle plate having a nozzle for ejecting said ink material therethrough;

wherein for each head section in a first portion of said plurality of head sections, an inner surface of a respective nozzle is covered with a coating, and for each head section in a second portion of said plurality of head sections, an inner surface of a respective nozzle is uncoated, said first portion of said plurality of head sections being different than said second portion of said plurality of head sections, said coating affecting an inner diameter of each nozzle having a coating so that at least one nozzle of a head section of said first portion of said plurality of head sections has an inner diameter different than an inner diameter of a nozzle of a head section of said second portion of said plurality of head sections.

7. An ink-jet recording head comprising:

a first unit comprising a plurality of first ink cavities therein, said first unit further comprising a first wall portion with a plurality of first nozzles respectively corresponding to said first ink cavities, said first nozzles extending through said first wall portion in a first extending direction from a first surface thereof to a second surface thereof, said first wall portion having a first thickness in said first extending direction, each first nozzle having a first cross section taken parallel to said first extending direction, each first nozzle having, at a position along said first extending direction, a first smallest diameter; and a second unit comprising a plurality of second ink cavities therein, said second unit further comprising a second wall portion with a plurality of second nozzles respectively corresponding to said second ink cavities, said second nozzles extending through said second wall portion in a second extending direction from a first surface thereof to a second surface thereof, said second wall portion having a second thickness in said second extending direction which is equivalent to said first thickness, each second nozzle having a second cross section taken parallel to said second extending direction, each second nozzle having, at a position along said second extending direction, a second smallest diameter equivalent to said first smallest diameter;

wherein a configuration of said first cross section is different from a configuration of said second cross section so that a diameter of an ink droplet ejected from said first nozzles is different from a diameter of an ink droplet ejected from said second nozzles.

8. An ink-jet recording head in accordance with claim 7, wherein said first and second units further comprise:

a plurality of pressuring members respectively corresponding to said first and second ink cavities, and wherein said pressuring members are adapted to being activated independently.

9. An ink-jet recording head in accordance with claim 7, wherein said first ink cavities of said first unit are aligned in a first direction, wherein said second unit is disposed on a side of said first unit, a position of said second unit relative to said first unit being along a second direction which is orthogonal to said first direction, and wherein said second ink cavities of said first unit are aligned in said first direction.

10. An ink-jet recording head in accordance with claim 9, wherein each of said pressuring members comprises a piezoelectric member.

* * * * *